US005515785A

United States Patent [19]

Zglenicki

[11] Patent Number: 5,515,785

[45] Date of Patent: May 14, 1996

[54] CHARGE CARRYING FLECHETTE PROJECTILE

[75] Inventor: Charles Zglenicki, Sparta, N.J.

[73] Assignee: The United States of America as represented by the Secretary of the Army, Washington, D.C.

[21] Appl. No.: 455,046

[22] Filed: May 7, 1965

[51] Int. Cl.[6] ..... F42B 12/00

[52] U.S. Cl. ..... 102/473; 102/512; 102/517; 102/703; 273/418; 604/130

[58] Field of Search ..... 102/42, 48, 56, 102/92, 92.5, 473, 512, 517, 703; 273/106.5, 418; 128/215–221; 604/130

[56] References Cited

U.S. PATENT DOCUMENTS

| | | | |
|---|---|---|---|
| 693,329 | 2/1902 | Neubauer | 102/512 |
| 1,819,415 | 8/1931 | Harris | 102/512 |
| 3,093,077 | 6/1963 | Harris et al. | 102/512 |

*Primary Examiner*—Harold J. Tudor
*Attorney, Agent, or Firm*—Anthony T. Lane; Edward Goldberg; Michael C. Sachs

[57] ABSTRACT

As an abstract of the disclosure, the invention is directed to a miniature projectile having a forwardly contained charge which is laterally injected into a target upon impact.

1 Claim, 1 Drawing Sheet

CHARGE CARRYING FLECHETTE PROJECTILE

The invention described herein may be manufactured and used by or for the Government for governmental purposes without the payment to me of any royalty thereon.

This invention relates to a dart-like projectile commonly known as a flechette, and particularly to a flechette having a protective chamber therein for carrying a charge.

A flechette, as is well known in the art, is a small diameter needle or dart-like projectile shaped for aerodynamically stable flight. Flechettes fall into two general categories, namely fin stabilized and drag stabilized flechettes. The former have three, four or more fins formed on the rear portion thereof to provide the flight stability required. The latter flechettes do not use fins but, rather, adjust the center of gravity of the projectile to achieve flight stability. The drag stabilized flechettes, for example, might be comprised of different materials with a heavier material forming the nose portion so as to concentrate the center of gravity more towards the nose. In all cases the flechettes were formed from solid stock of the material to be used.

In both categories of flechettes certain applications require that the body of the flechettes be filled with a charge. In providing such a hollow flechette several problems are involved. The foremost problem is that of economically drilling a cavity or chamber into the forward portion of the solid flechette, especially where large quantities of flechettes are needed. When considering that the flechettes extensively used in large quantities are relatively small in diameter (1/16 inch is not uncommon) this drilling problem is not difficult to comprehend. A high degree of care is necessary during manufacturing, thus resulting in a high cost for each unit. A further problem arises with regard to the specific charge desired to be put into the particular flechette. Certain charges may be highly toxic and reactive with the metal of the flechette. Under these circumstances it becomes necessary to line the cavity or chamber with a non-corrosive protective material. This, of course, required another operation after drilling of the cavity, thus adding to the cost per unit. Furthermore, it was also necessary to close the tip of the flechette with a non-corrosive plug. Finally a breakthrough or discharge port was needed for the charge to eject upon impact of the flechette with a target. A radially oriented hole had to be drilled through the wall of the flechette and filled with a non-corrosive material to seal in the charge until target impact.

Accordingly, it is the primary object of the present invention to provide a flechette having a protective chamber for carrying a charge, which flechette is economical to manufacture in mass production quantities.

Another object of the present invention is to provide a flechette of the above type which does not require any drilling operations after it is formed for the chamber or for a breakthrough or discharge port.

Still another object of the present invention is to provide a flechette of the above type which is manufactured from a singular tubular body of metal having an inner tube of non-corrosive protective material.

Further objects of the present invention will in part be obvious and will in part appear hereinafter.

For a fuller understanding of the nature and objects of the invention, reference should be had of the following detailed description taken in connection with the accompanying drawings wherein.

Figure 1:
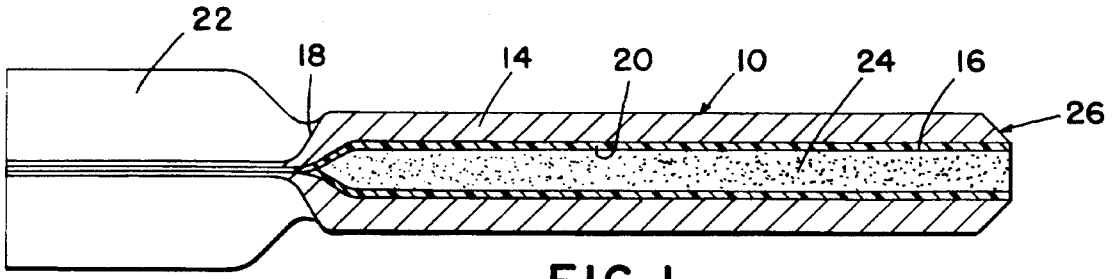
FIG. 1 is a longitudinal view, partly in cross section, of the projectile embodying the present invention.
Figure 1A:
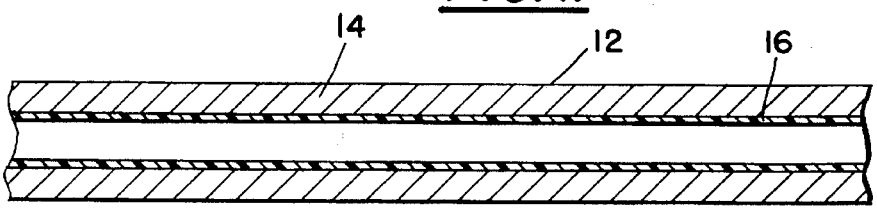
FIGS. 1A and 1B represent a diagrammatic progression of the forming of the projectile of FIG. 1.

Referring to the drawings the flechette 10 of FIG. 1 of the present invention is formed from a single piece of a composite tubing 12 as shown in FIG. 1A. The tubing 12 comprises a rigid walled outer tubing 14 which may be a metal such as steel or the like, and an inner tubing 16 of a non-corrosive flexible material such as polytetrafluoroethylene, sold under the trademark TEFLON. The inner tubing 16 is preferably a seamless tube, and can be of any flexible material suitable to use with a particular charge. The composite tubing 12 is formed by familiar manufacturing operations which consist essentially of feeding the inner tubing 16 into the outer tubing 14 during a rolling operation. While the outer tubing 18 is being rolled an adhesive is placed on the inner tubing 16 and the rolling operation continued until a composite tubing 12 is formed. The butt joint of the outer tubing 14 may be jointed tightly, welded together, or left partially open to provide a break-through or discharge area for the finished flechette as will be made clear further on herein.

Figure 1B:
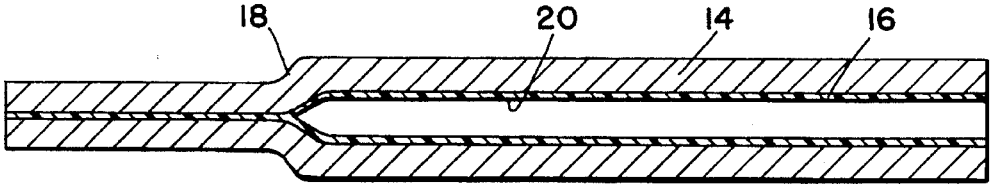
Figure 2:
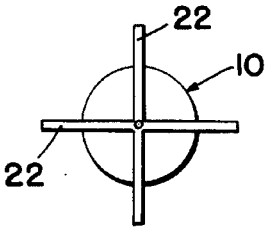
FIG. 2 is an end view of FIG. 1 showing further details of construction.

A suitable length of composite tubing 12 is cut as shown in FIG. 1A. A portion of the tubing is pressed as at 18 to form one closed end of a compartment or chamber 20, as shown in FIG. 1B. In this embodiment the pressed portion 18 forms the rear end portion of the flechette 10. Fin stablizers 22 are formed on the rear end as shown in FIGS. 1 and 2. Four fins 22 are shown but are not limited to this number and may vary according to desired needs.

A charge 24 may be inserted into the chamber 20 by methods well known in this art. The chamber 20 has a diameter of such a small magnitude that the charge 24 will be retained therein under capillary action. Further retention of the charge 24 within the chamber 20 during transportation of loaded items can be assured by suitable coverings.

The forward end 26 may be formed into a frusto-conical or other curvilinear configuration tip in order to enhance and improve the flight characteristics of the flechette 10. The charge 24 may be of any type desirable for a particular application where a protected chamber is needed. The flechette of this invention will have particular use with a toxic or explosive charge which is not compatible with metals normally used to manufacture flechettes.

Figure 3:
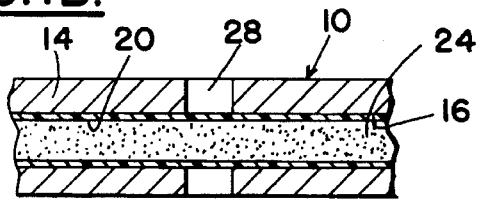
FIG. 3 is a fragmentary portion of a projectile of this invention as illustrated in FIG. 1 showing a modification thereof.
Figure 4:
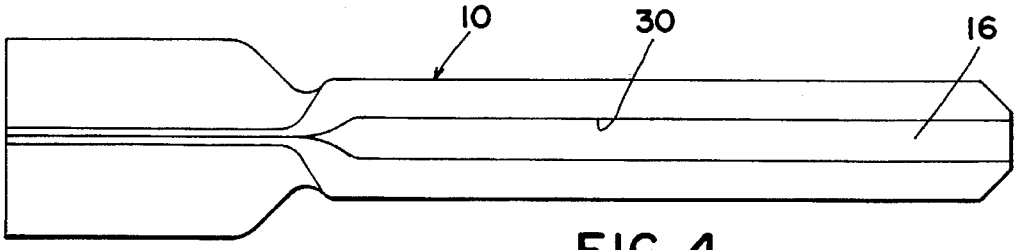
FIG. 4 is a side view of a projectile embodying the present invention as illustrated in FIG. 1 showing a further modification thereof.

A breakthrough or discharge area may be provided for ejection of the charge 24 upon impact of the flechette 10 with a target. These discharge areas may take the form of an opening 28 or a plurality thereof made through the wall of the outer tubing 14 to, but not through, the inner tubing 16. The opening 28 is shown in FIG. 3. The thickness of the inner tubing 16 may be made of a magnitude such that upon impact of the flechette 10 with a target the pressure increases within the chamber 20 will result in the inner tubing 16 bursting at the opening 28 and ejecting of the charge 24 therethrough. The opening 28 or, if desired, a plurality thereof may be made in the outer tubing 14 prior to the rolling operations for forming the composite tubing 12. A breakthrough or discharge area may also be provided by forming the flechette 10 from a piece of composite tubing 12 having a clearance between the butt ends of the outer tubing 14. By following the aforesaid forming procedures, a flechette 10 will be formed, as shown in FIG. 4, having a longitudinal opening 30 for ejecting the charge 24 upon impact of the flechette 10 with a target.

It has been found that a considerable savings in manufacturing time, thus, in money by forming flechettes in conformance with this invention. This savings is realized over the old hollow flechette formed by drilling a solid body of material to provide a chamber and a breakthrough or discharge area.

It is pointed out that the examples in the drawings have been enlarged for clarity and are not necessarily to be regarded as defining exact physical specifications.

Since the invention described herein may be variously practiced without departing from the spirit and scope thereof, it is not intended that it be limited except as is required by the appended claims.

I claim:

1. A dart-like, charge carrying flechette projectile having a forward end and a rearward end comprising an integral body of rigid walled material, a flexible protective liner throughout the length of said body, said body and liner pressed at a point intermediate their ends and open at their forward ends to form a fully protected chamber therebetween containing a charge, said forward end shaped to a curvilinear configuration for improving the flight characteristics of the projectile, a plurality of fin stabilizers formed from said body rearwardly of said chamber, and a breakout area through the wall of said body intermediate said pressed end and said forward end for ejecting the charge therethrough upon impact with a target.

* * * * *